United States Patent [19]

Coucher

[11] Patent Number: 4,988,289

[45] Date of Patent: Jan. 29, 1991

[54] REACTION FURNACE

[75] Inventor: Robert G. Coucher, Salt Lake City, Utah

[73] Assignee: Custom Equipment Corporation, Salt Lake City, Utah

[21] Appl. No.: 485,387

[22] Filed: Feb. 26, 1990

[51] Int. Cl.[5] ..... F27B 7/36

[52] U.S. Cl. ..... 432/103; 432/107; 432/112; 432/114

[58] Field of Search ..... 432/103, 107, 109, 110, 432/112, 114

[56] References Cited

U.S. PATENT DOCUMENTS

| | | | |
|---|---|---|---|
| 1,587,727 | 6/1926 | Harty et al. | 432/114 |
| 2,207,987 | 7/1940 | Kent et al. | 432/114 |
| 3,658,654 | 4/1972 | Gutberlet . | |
| 3,787,292 | 1/1974 | Keappler | 432/107 |
| 4,043,745 | 8/1977 | Unger | 432/114 |
| 4,308,103 | 12/1981 | Rotter . | |
| 4,376,343 | 3/1983 | White et al. | 432/112 |
| 4,393,603 | 7/1983 | Casperson | 432/112 |
| 4,427,376 | 1/1984 | Etnyre et al. | 432/114 |
| 4,504,222 | 3/1985 | Christian | 432/110 |
| 4,686,008 | 8/1987 | Gibson . | |
| 4,850,861 | 7/1989 | Poroshin et al. | 432/114 |

*Primary Examiner*—Henry C. Yuen

*Attorney, Agent, or Firm*—Trask, Britt & Rossa

[57] ABSTRACT

A reaction furnace includes a rotating core within a heated shell, the core and shell defining an active annular zone. An interrupted helical screw carried by the core conveys material from an inlet at one end of the zone to an outlet at the opposite end of the zone. The furnace is operated with the annulus only partially filled. Volatiles rise to a void space at the top of the annulus and are drawn off.

40 Claims, 6 Drawing Sheets

REACTION FURNACE

BACKGROUND OF THE INVENTION

1. Field

This invention relates to furnaces of the type which provide a heated active zone for inducing reactions in feed material conveyed through the zone. It is particularly directed to furnaces of this type in which the active zone is annular and substantially horizontal.

2. State of the Art

Reaction furnaces of various types are well known. They have long been used for removing moisture and other volatiles from contaminated or raw material feed stocks. They have also been used to alter the chemical composition of feed stocks or to effect the chemical reaction or breakdown of constituents in the feed. In any event, such furnaces, or kilns, conventionally comprise a chamber within a housing or structural support, means for heating all or a portion of the chamber and means for moving material through the heated, or active, zone of the chamber.

An exemplary type of reaction furnace is the rotary kiln. Such kilns have found broad application in the chemical and minerals processing industries. In many applications, such as the regeneration (or reactivation) of carbon, kilns are generally not process sensitive; that is, they are capable of regenerating carbon from a variety of sources without regard to variations in moisture content or the presence of fouling contaminants, such as flotation reagents or lime. Kilns can be constructed to vent volatiles and steam from the vicinity of the reaction zone. They are capable of operation whether feed is present in the active zone or not. All of these features are advantageous, but rotary kilns nevertheless suffer from certain disadvantages and limitations.

A rotary kiln comprises a cylindrical barrel which is heated to a high temperature and rotated for prolonged periods between supports. The barrel is only partially filled with feed material The material is dynamically mixed as it travels from the feed end to the discharge end of the barrel. The barrel length must be substantial, generally no less than twelve feet, to provide adequate residence time within the active zone and adequate capacity. For large capacity operations, kiln barrels as long as forty (40) feet and having diameters of four feet or more are not uncommon. The natural tendency of the barrel to sag is increased by the elevated temperature of operation typically 1200° to 1500° F. As the barrel rotates, reverse bending inevitably occurs, inducing high stress and ultimate structural failure. Construction of a rotary kiln with a reasonable life expectancy is thus very expensive. To the extent that economies of construction are attempted, the reduced quality and/or quantity of machined parts leads to additional stress-related problems; e.g. shock. Increasing the strength (and thus the weight) of the barrel raises the cost of construction inordinately for most applications, because all of the ancillary components required to support and drive the barrel must also be increased in size and/or number.

Another type of reaction furnace which has gained commercial success for a variety of applications is the vertical kiln in which the active zone comprises a plurality of tubes or an annulus between concentric cylinders. The active zone is disposed approximately vertically and is entirely filled with material during operation. Feed material is introduced at the top of the zone and migrates downward under the influence of gravity. The zone is thus static and avoids many of the stress-related problems associated with rotary kilns. Of course, the static zone cannot provide the dynamic mixing characteristic of a rotary kiln. Vertical kilns have the advantage of comparatively low cost construction, even from high quality materials, and require relatively little installation space. They are practical for on-site installations in situations which would not justify the installation of a rotary kiln. Vertical furnaces, however, also suffer from certain limitations and disadvantages.

The temperature gradient from the bottom to the top of the active zone in a vertical furnace is typically substantial. Feed enters the top of the zone carrying moisture and volatiles. Steam and other gases are thus driven from the feed as it migrates downward and gains heat energy. Inevitably, volatiles and steam rising from the lower portion of the active zone (which is of relatively high temperature) tend to reflux (condense) as they enter a cooler upper region of the active zone. These refluxed materials may become sufficiently concentrated to eventually pass out the discharge end of the active zone. In any event, the capacity of the furnace is negatively impacted by the necessity for revolitilization of condensed materials. Another significant problem encountered with vertical furnaces is the tendency of feed material to become confined, sometimes compacted, by virtue of the relatively limited cross-sectional area of the active zone. Flashing or blow-back of feed from the furnace is thus possible, especially if the porosity of the feed material is reduced by compacting or refluxing of volatiles.

The regeneration of activated carbon used in a variety of chemical, mineral processing and water treatment applications is of increasing importance. While the rotary kilns and vertical furnaces heretofore available can be used for that purpose, they have not been entirely satisfactory. The consumers of reactivated carbon are typically not economically structured to acquire and operate a rotary kiln. It has thus become the practice for many such consumers to arrange for spent carbon to be hauled to and from a rotary kiln owned by another for processing. The scale of operation of the kiln is often such that the consumer cannot be guaranteed return of the specific carbon sent out for processing. Thus, each consumer risks receiving reactivated carbon with unfamiliar or hazardous contaminants. Moreover, contract reactivation of this type has been very expensive and has customarily imposed a kiln loss of between ten to fifteen percent on the consumer. The use of vertical furnaces on site, while more economical and while imposing a kiln loss of typically about five percent (5%), requires operational and maintenance expertise. The refluxing and blowback tendencies of presently available vertical kilns have discouraged their use despite their inherent economic and processing advantages.

There remains a need for an improved reaction furnace which offers the advantages of a rotary kiln but also offers the low cost and low space requirements of a vertical furnace without the attendant disadvantages of refluxing and blowback inherent in such furnaces. Such an improved reaction furnace would find use in many applications currently served by existing types, but it would find specific application in on-site installations for the regeneration of carbon.

SUMMARY OF THE INVENTION

The present invention provides a furnace which requires substantially less volume per unit of throughput than does a conventional rotary kiln. It can thus be constructed for a fraction, typically less than a third, of the cost of constructing a rotary kiln of equivalent throughput capacity. The furnace of this invention avoids the severe mechanical stresses of operation typical of rotary kilns, while providing improved dynamic mixing in the active zone. While it offers the low kiln losses, costs of construction, and installation space requirements typical of vertical kilns, it avoids the reflux and blowback problems of these devices.

As a matter of convenience and for purposes of clarity, the invention will be described in this disclosure with principal reference to the regeneration of carbon. It is not intended thereby to imply that the invention is a special purpose device. To the contrary, it is believed that the furnace of this invention is highly versatile and will find broad application in many fields of use, including the chemical, minerals processing, food processing, construction and pharmaceutical industries.

The furnace of the invention differs from a rotary kiln in that the outer casing or barrel, which is the element to which heat is directly applied, is static. The central axis is non-vertical, and the furnace thus differs from vertical kilns in that migration of material through the active zone is effected by a rotating core rather than mere gravity. Because of the core, the active zone is actually annular. The annulus is narrow in cross-section, compared to the cross-section of the barrel. In practice, the annulus is only partially filled with feed material, and the core thus typically receives sufficient radiant energy from the heated barrel to reach a temperature above the target temperature of the feed material in the annular active zone. Accordingly, the claimed furnace may be embodied to offer many of the benefits and advantages of annular vertical furnaces of the type disclosed in U.S. Pat. No. 4,462,870, the disclosure of which is incorporated by reference as a part of this disclosure.

An important feature of the invention is the provision of a void space at the top of the annular active zone. In most instances, the central axis of the barrel will be substantially horizontal, although a slight incline is sometimes beneficial to either promote or resist the migration of material through the zone. The furnace is operable with the axis oriented at a substantial incline from horizontal, but except for special applications there is ordinarily no benefit from such an orientation. Accordingly, this disclosure will describe the furnace in its horizontal orientation, and for most purposes, the claimed furnace may be regarded as a horizontal furnace.

The rotating core includes a drum element mounted on a shaft. The inner surface of the barrel and the outer surface of the drum define the annular active zone. Although various means for transporting material from a first (entry) end of the annular zone to the opposite (exit) end of the zone are operable, it is currently preferred to dispose conveyor means of some type in association with the drum. A screw conveyor is conveniently fashioned by mounting a helical blade on the exterior surface of the drum within the annular zone. In highly preferred embodiments, the helical blade comprises a plurality of spaced, optionally overlapping, blade segments. The resulting interrupted helical blade promotes the release of volatiles and cascade mixing. Mixing may further be promoted by means of lifters connected to the blade segments.

Heat may be applied to the barrel in any convenient fashion. Direct or indirect flame heating, radiant heating, or electric coil wrapping heaters are all practicable. Ceramic electric radiant heaters are presently preferred. In any event, with the barrel heated, the rotating core, which is typically constructed of heat conductive metal, receives sufficient radiant energy from the barrel to constitute a secondary heat source for the annular chamber. Typical barrel diameters range from about two (2) to about four (4) feet. The width of a typical annular active zone ranges from about one (1) to about eight (8) inches. Accordingly, radiant heating of the core is effective. Uniform temperature of the core around its cross-sectional circumference is assured by its continuous rotation.

It is practical, and often preferred, to establish separately controlled subzones within a heating zone disposed between the entry and exit ends of the annular active zone. A portion of the active zone at the entry end is disposed within an inlet section. A second portion of the active zone at the exit end is disposed within an outlet section. The portion of the active zone between the inlet and outlet sections comprises the heating zone and in some instances boundary or transition zones. The length of heating zone required for a specific application will depend upon certain construction constants of the furnace; e.g. annulus width and barrel diameter, certain characteristics of the feed material; e.g moisture content and its apparent coefficient of conductance, and process parameters, such as the target temperature to which the feed material is to be elevated, and the retention time desired. The length of the heating zone utilized may thus be modified as desired by activating or deactivating subzones as needed. The temperature gradient from entry to exit of the heating zone is usually approximately linear. In other instances, the process may require maintaining different target temperatures at different subzones For on-site installations, a furnace of standard design specifications may be suitable. A standard furnace may be operated for longer or shorter portions of a day or at various temperatures, or speeds of core rotation as needed. Alternatively, a furnace of this invention may be designed specifically to meet the requirements of the site. Many choices of barrel size, drum speed, annulus width materials of construction and the like are available. Nevertheless, there is an inherent relationship between annulus width and retention time (drum speed and heating zone length) needed to impart adequate heat energy to the feed material. Moreover, a large value of the apparent coefficient of conductance (k) of the feed material permits use of a wider annulus The barrel size selected impacts on the ratio of heated contact surface to throughput volume. Another factor influencing the width of the annulus and the diameter of the drum selected is the degree to which the annulus is to be filled in operation. The fill level of the annulus may be fixed by the positioning of entry ports in the inlet section of the furnace. Generally, it is desired that the annular active zone be filled to between about $\frac{1}{3}$ to about $\frac{2}{3}$ of its cross-sectional area to maintain good mixing action, volatile release and adequate retention time within a practical heating zone length.

The shaft is isolated from the heated barrel by the drum and by its relatively large spacing from the inside surface of the drum. Radiant heating is thus of relatively modest consequence to the shaft. The shaft ordinarily remains relatively cool, but if necessary, it can be water cooled to avoid significant expansion during operation. The drum itself may be mounted to the shaft in a fashion which permits free axial travel with respect to the shaft, thereby avoiding thermal stresses. It is usually desirable to journal opposite ends of the shaft through sealed bearings so that a slight negative pressure can be maintained within the active zone.

The inlet section includes a feeder device, such as a hopper, which directs feed material, preferably by gravity flow, through ports in the barrel at a selected elevation with respect to the central axis of the barrel. Location of the ports regulates the fill level of the annular active zone. It is within contemplation that the elevation of the fill ports may be adjustable to accommodate selected fill levels.

The outlet section includes a mechanism for discharging product such as regenerated carbon. The device should retain pressure isolation of the active zone from the ambient environment. A heater lock device is presently preferred for this purpose. A product isolation/-discharge device may be incorporated as a portion of the last blade in the exit direction of a screw conveyor carried by the rotating drum.

Inert gases, steam or other atmospheric conditions may be injected into the active zone in conventional fashion.

BRIEF DESCRIPTION OF THE DRAWINGS

In the drawings, which illustrate what is presently regarded as the best mode for carrying out the invention.

DESCRIPTION OF THE ILLUSTRATED EMBODIMENTS

Figure 1:
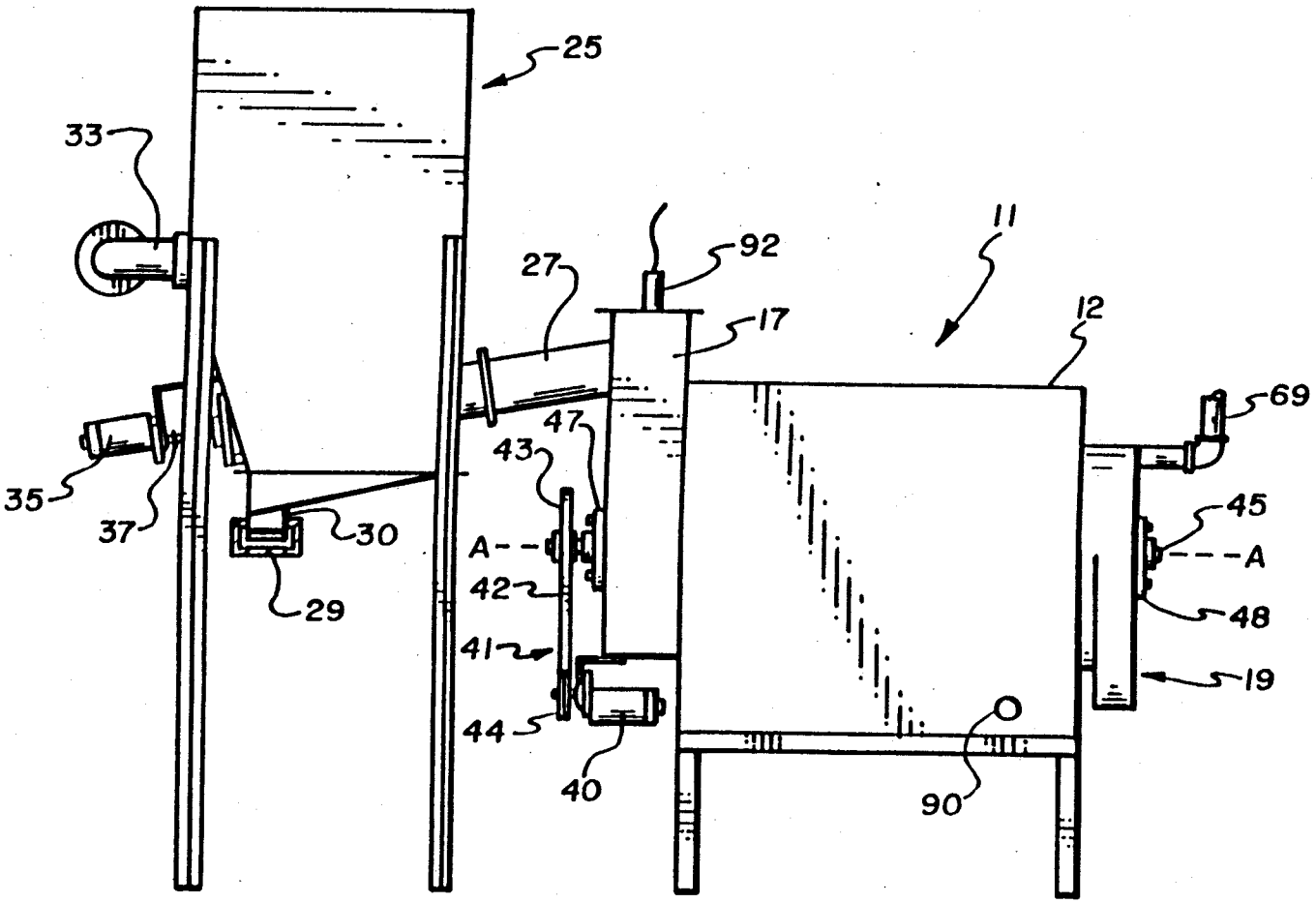
FIG. 1 is a view in side elevation, partially in section, of a typical plant installation incorporating the invention.
Figure 2:
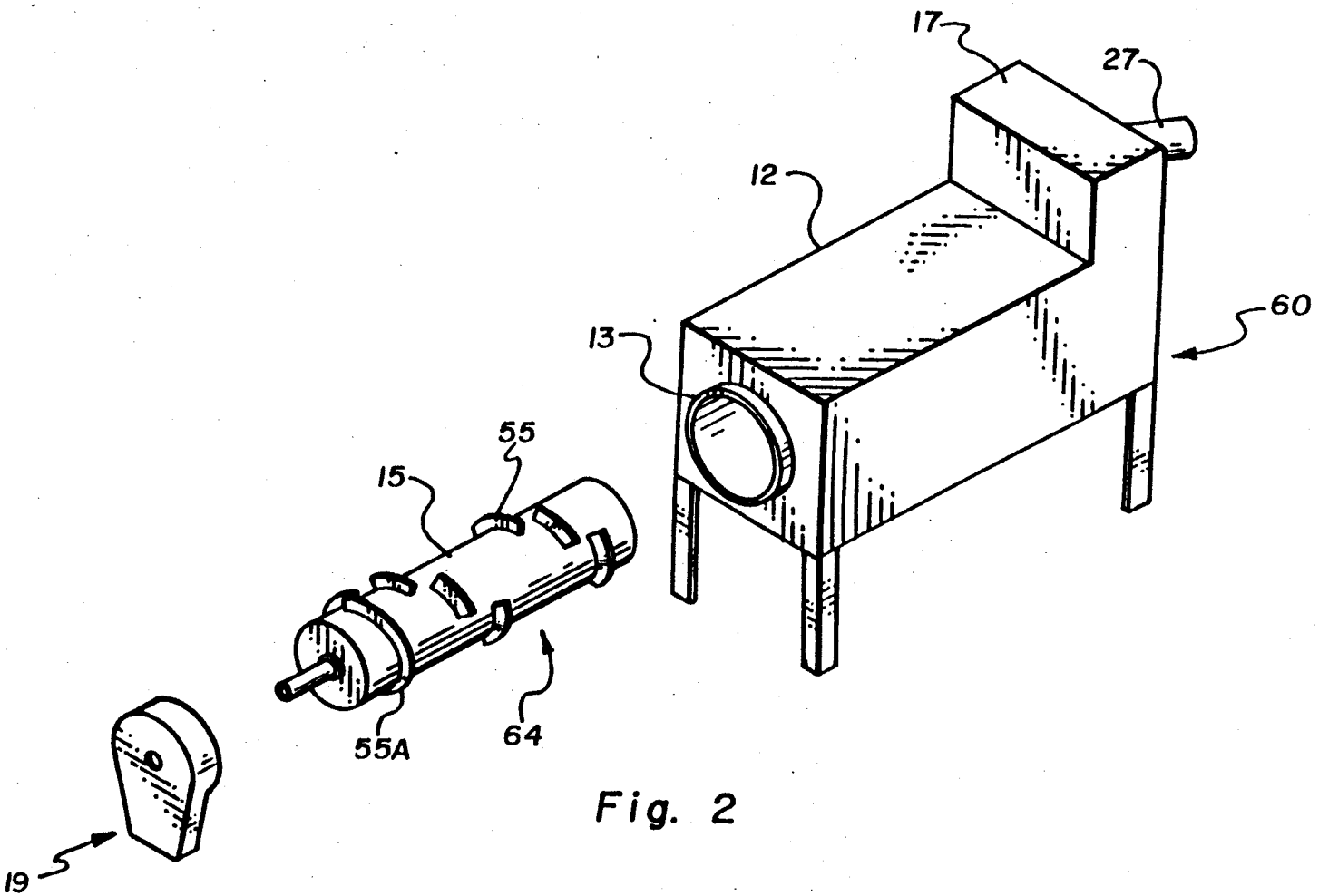
FIG. 2 is an exploded view showing certain components of one embodiment of the invention.
Figure 3:
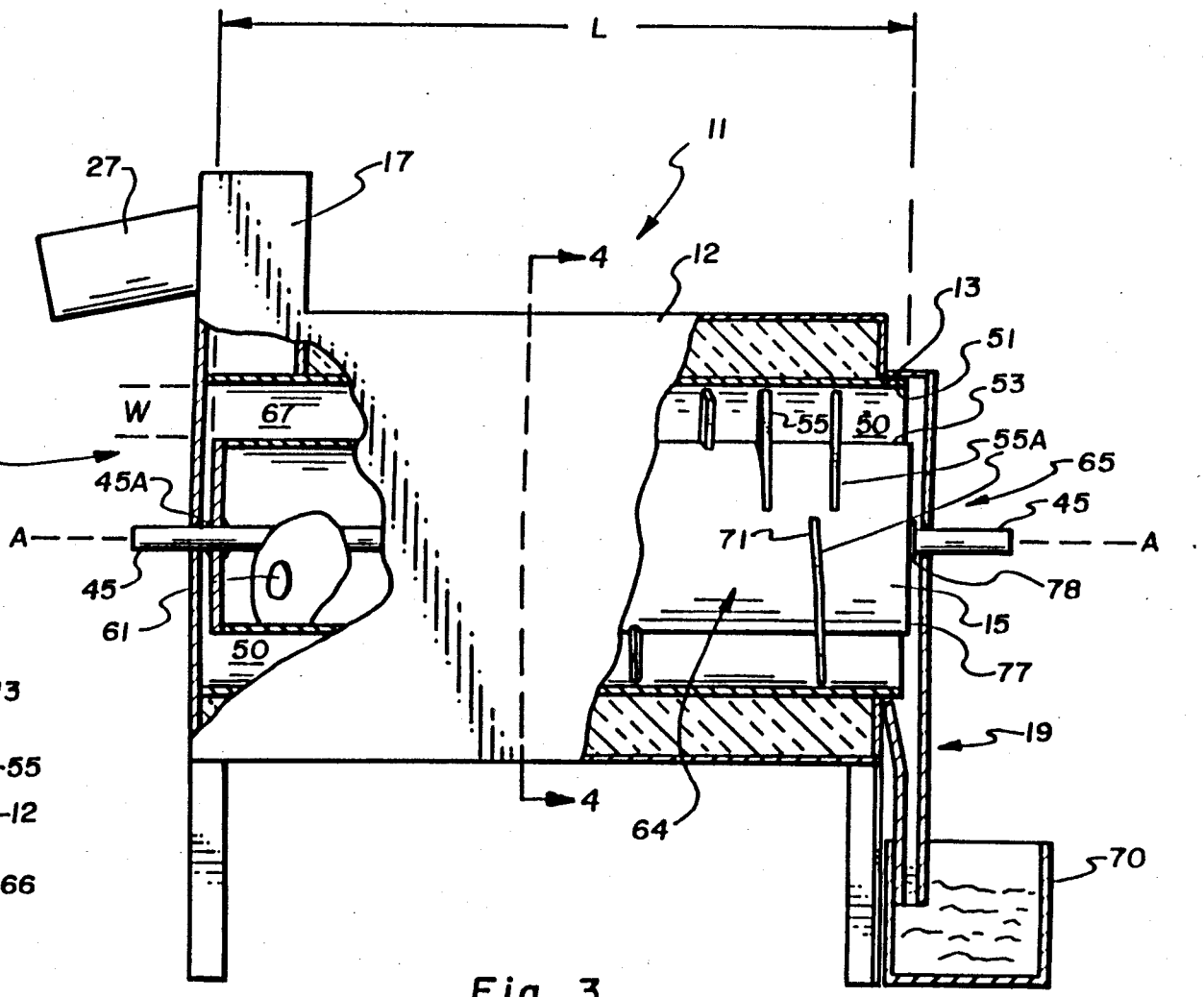
FIG. 3 is a view in elevation, partially broken away, of the embodiment of FIG. 2 in assembled condition.
Figure 5:
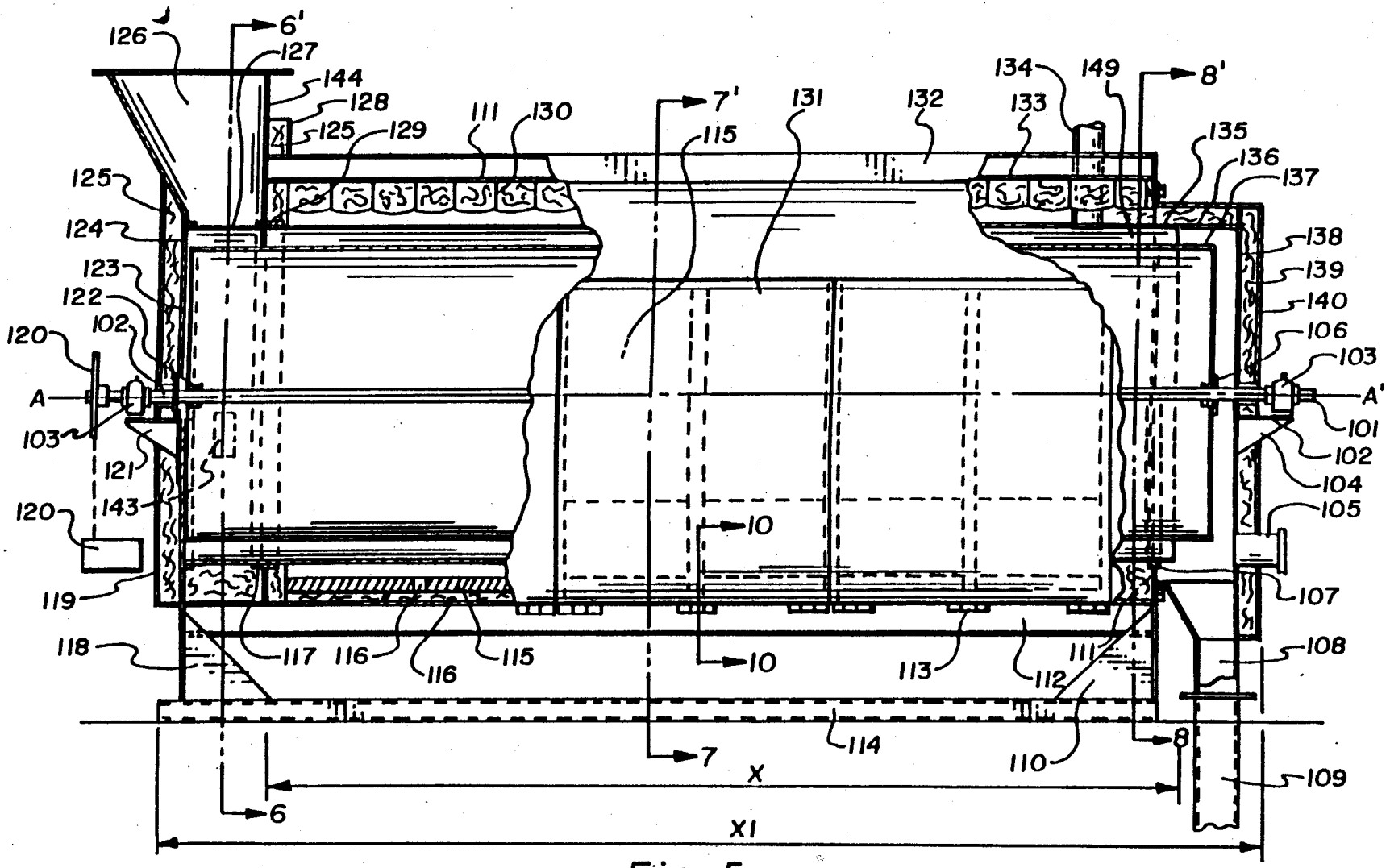
FIG. 5 is a view in elevation, partially broken away, of another embodiment of the invention.

A typical installation of a furnace 11 of this invention, as illustrated by FIG. 1, includes an external housing 12 which contains a barrel element 13, a drum element 15 and associated components (see FIGS. 2 and 3). A feed hopper 17 is located at a first or inlet end of the housing 12. A discharge assembly 19 is located at the second or outlet end of the housing 12. As illustrated, the central axis A—A of the furnace 11 and its major structural components (see FIGS. 2, 3 and 5) is approximately horizontal.

The arrangement illustrated by FIG. 1 can be put to various applications, including volatilizing contaminants, drying and reacting materials, but will be described with particular reference to the regeneration (reactivation) of carbon. For this application, a carbon bin, designated generally 25, is advantageously disposed as shown to discharge through a conveyor tube 27 into the feed hopper 17. Although the carbon bin 25 is shown in the proximity of the furnace 11, in practice, the bin 25 may be remote from and at any elevation with respect to the furnace 11. It is merely required that suitable means, such as the conveyor tube 27 illustrated, be provided to transport carbon from the bin 25 to the hopper 17. In some circumstances, the bin 25 is mounted directly above the hopper 17 and feed material transfer is by gravity feed.

The carbon bin 25 typically includes a drain screen 29 and drain 30 beneath the level of conveyor 27. It is usually considered desirable for carbon to enter the hopper at a specified moisture content, e.g., twenty percent (20%) by weight. For this reason, a dryer assembly 33 is ideally associated with the bin 25. In the illustrated instance, the dryer assembly is of the evaporative type in which a heated air stream is injected into the bin 25 when the carbon within the bin achieves the desired moisture level, a gear motor 35 is turned on to drive the conveyor shaft 37 of a feed screw (not visible) housed in the tube 27, thereby transporting carbon to the hopper 17.

A second gear motor 40 is connected through a belt drive 41, including a "V" belt 42 and sheaves 43, 44 to turn a shaft 45 journaled through pillow blocks 47, 48. The shaft 45 turns the drum element 15 within the barrel element 13 (see FIG. 3). The shaft 45, drum 15 and barrel 13 are coaxial with axis A—A so that an annulus 50 is formed between the stationary interior surface 51 of the static barrel element 13 and the moving exterior surface 53 of the drum. The surfaces 51 and 53 are approximately cylindrical, comprising surfaces of approximately cylindrical structural components. The interior surface 51 of the barrel 13 thus defines an approximately cylindrical chamber within which the moving structures, the shaft 45, drum 15 and blade segments 55, move. Typically, the moving structure simply rotates in a fixed direction, but other modes of material-conveying motion are within contemplation.

Figure 4:
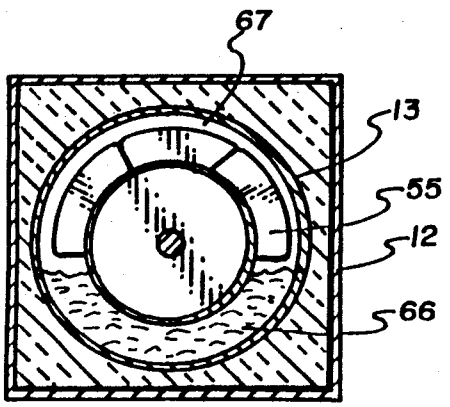
FIG. 4 is a schematic view in cross-section, taken at the reference line 4—4 of FIG. 3 viewed in the direction of the arrows.

In the embodiment illustrated by FIGS. 2 through 4, the barrel 13 and drum 15 elements extend in both axial directions beyond the housing 12. The feed hopper 17 cooperatively forms with other structural components an inlet section, designated generally 60. Particulate material, in this case carbon, is gravity fed from the hopper 17 through ports 61 into the annular active zone 50. As noted previously, the cross-sectional area of the annulus 50, as a fraction of the cross-sectional area of the chamber (internal volume of the barrel 13), will be selected to suit the particular application at hand. The width W of the annulus as well as its length L will also be selected based upon practical economic and process considerations. At all events, however, the annulus will be relatively narrow, typically a few inches. For example, an annulus of three inches has been found satisfactory for the reactivation of carbon in a furnace of the structure illustrated, sized to regenerate approximately two tons of carbon during twenty (20) hours of operation.

The drum 15 and the blade segments 55 constitute a rotating core 64 which slowly; typically about ½ to about 3 rpm at a helical advance per revolution of about ½ to about 1½ feet, rabbles and advances the carbon towards an outlet section, designated generally 65. The amount of material 66 in the annulus 50 depends upon the location of the entry ports 61. As illustrated, approximately thirty-five percent (35%) of the annulus is filled with particulate carbon. As presently contemplated, it would ordinarily be of no advantage to fill the annulus above the level of the axis A—A, although the furnace would be operable for certain applications, particularly where radiant heating of the drum 15 by the barrel 13 is of less consequence, even if the annulus 50 were nearly completely filled.

It is currently regarded as highly desirable to maintain a space 67 at the top of the annulus unoccupied with particular material This void space 67, which typically occupies at least half of the volume of the annulus 50, facilitates cascading of material lifted by the blades 55, thereby preventing compaction of the material being transferred from the inlet section 60 to the outlet section 65. As the blades 55 contact the carbon, entrapped steam and volatiles are released to the void space 67. They are then transported under the influence of a slight negative pressure from the annulus 50 through a fume exit 69. The temperature gradient within the annulus 50 rises approximately linearly in the direction of material advance. Moreover, volatilized material is drawn towards a hotter region by the direction of the fume exit 69. In addition, radiant heating of the void space 67 by the barrel 13 assures that the volatiles rise vertically into a region at least as hot as the volatilization temperature. All of those factors assure against refluxing (condensing) of the volatile constituents. In the specific case of carbon, any mercury contaminant present will be distilled and drawn out of the furnace along with the steam and other volatile.

Maintenance of a slight negative pressure, on the order of about ½ to about 3 inches of water volume, within the furnace 11, contributes to the effectiveness of the pillow block 47, 48 seals and the isolation of the active zone 50 from the ambient pressure conditions adjacent the inlet section 60, the outlet section 65 and the bin 25. Pressure isolation at the outlet 19 is also provided by a water lock device 70 (FIG. 3) in the outlet section 65.

The outlet section 65 receives the outlet or exit portions of the barrel 13 and drum 15, the fume exit 69, the discharge assembly 19 and the pillow block mounting 48 of the shaft 45. Carbon entering the outlet section 65 exits through the discharge assembly 19 from which it is captured for storage or transport, depending upon the particular installation involved. The last blade 55A of the core 64 is configured as a discharge ring 71 which spills material into the discharge assembly 19.

The core 64 is fixed to a hollow shaft 45 at one end 45A but is otherwise free to move in the axial direction with regard to the shaft 45. Such freedom of movement is desirable because of varying differentials in temperature which inherently develop between the core 64 and shaft 45 during operation. The shaft 45, being isolated from the active zone 50, remains relatively cool during operation and may even be cooled by circulating cooling water through its hollow interior to avoid thermally-induced stresses. By contrast, the drum 15 partially defines the active zone 50 and can attain temperatures approaching those of the barrel 13. The drum 15 may be supported as needed at intermediate locations by spider supports (not shown) which allow the drum 15 to move freely as it expands. The discharge end 77 of the drum 15 is supported on the shaft 45 by a sliding sleeve 78.

Heat may be provided to the annular active zone 50 in any convenient fashion. Gas flames or other fluid heat energy sources may be applied directly to all or selected portions of the outside surface of the barrel 13, for example. As presently preferred, electric heating elements (not shown) are generally placed as required adjacent a prescribed heating zone comprising a major portion of the annular active zone 50.

According to a presently preferred embodiment, three ceramic shell electric heaters are Wye connected to a three phase power supply to form a single bank (not shown). The individual heaters are sized so that a plurality of banks will provide the total heat energy required. Individual banks may be connected to separate controllers and positioned in discrete subzones. This arrangement of heating elements provides for more sensitive and responsive heat regulation, thereby avoiding localized hot spots or cold spots within the active zone.

Control of the heaters, motors 35, 40 and associated auxiliary equipment (e.g. a vacuum source for the fume exit 69) may be manual or automated. Temperature sensors 90, such as type K or other suitable thermocouples, may function as input devices for appropriate gauges or electronic control devices. A level control assembly 92 mounted atop the feed hopper 17 maintains the feed supply between minimum and maximum limits.

EXAMPLE 1

A furnace of this invention may be designed and scaled depending upon its intended application by selectively or empirically determining certain design criteria, namely:

1. The target (or exit) temperature (usually in °F.) desired for the discharge from the furnace.
2. Rate, usually expressed as pounds per hour, of product it is desired to recover from the furnace.
3. The annulus width, as determined by analysis of the physical properties of the feed, particularly the coefficient of conductance (k).
4. The percent moisture in the feed.
5. The barrel area required to heat the feed to the target temperature, derived empirically or from the physical properties of the feed.

Some of these criteria may be fixed by experience or judgment. For example, the annulus width selected is a matter of choice within practical limits. As previously noted, a higher apparent coefficient of thermal conductance (k) permits a wider annulus, but increasing the annulus width requires more heat and/or greater retention time. It should also be noted that the design approach suggested by this example assumes that the entire barrel surface is available to conduct heat energy to the feed material. In practice, the annulus is usually only partially filled. It has been found that the radiant heat energy emitted by the barrel to the core through the void portion of the annulus approximately compensates for the reduction in conductive contact. For design purposes, it is thus valid to treat the heat energy in the system to be equivalent to the amount which could be transmitted by conductance to a filled annulus.

Based upon the total barrel area determined, the designer may select either the length or the diameter of the heating zone and calculate the other.

Table 1 reports the significant design parameters, including the five design criteria noted, for a number of practical embodiments of this invention designed for the regeneration of activated carbon. The apparent coefficient of conductance was empirically determined through the operation of another type of carbon regeneration furnace to be 5.5 BTU inch/square ft. hour °F.

TABLE 1

| Parameter | Furnace No. 1 | 2 | 3 | 4 | 5 |
|---|---|---|---|---|---|
| Exit Temperature (°F.) | 1200.0 | 1250. | 1200. | 1400. | 1250. |
| Specific Heat of Product | 0.35 | 0.35 | 0.35 | 0.35 | 0.35 |
| Annulus Width (inches) | 1.50 | 2.0 | 3.0 | 3.0 | 3.0 |
| Pounds of Product Per Hour | 50.0 | 100. | 250 | 500 | 1000 |
| Percent Moisture In Feed Material | 40.0 | 35. | 39 | 42 | 45 |
| Pounds of Feed Per Hour | 83.0 | 154. | 410 | 862 | 1818 |
| Pounds of Water Per Hour | 33.0 | 54. | 160 | 362 | 818 |
| Total Heat Input Required (BTU) | 71951. | 128213. | 350260 | 802145 | 1671009 |
| Total Power Input (kilowatts) | 21.0 | 38. | 103 | 235 | 490. |
| Banks of Heaters | 2 | 3 | 6 | 8 | 12 |
| Heaters per Bank | 2 | 4 | 4 | 6 | 6 |
| KW per Heater Bank | 10.54 | 12.52 | 17.11 | 29.38 | 40.81 |
| KW Per Heater | 5.27 | 3.13 | 4.28 | 4.90 | 6.80 |
| KW Per Square Foot of Heater Surface Area | 1.25 | 1.28 | 1.32 | 1.17 | 1.38 |
| Length of Heating Zone (feet) | 3.3 | 5.0 | 10.0 | 13.3 | 20.0 |
| Area of Heat Transfer Surface Required (Square Feet) | 24.5 | 43.7 | 119.5 | 273.6 | 569.9 |
| Diameter of Barrel (feet) | 2.3 | 2.8 | 3.8 | 6.5 | 9.1 |
| Cubic Feet of Material in Annulus | 1.0 | 2.4 | 9.8 | 23.0 | 48.5 |
| Pounds of Material in Annulus | 28. | 66. | 69 | 633 | 1334 |
| Number of Blades in Hot Zone | 7 | 7 | 10 | 18 | 20 |
| Blade Advance (Inches Per Revolution) | 1 | 1.5 | 2 | 1.5 | 2 |
| Retention Time in Heating Zone (minutes) | 60 | 60 | 60 | 60 | 60 |
| Required Drum Speed (RPM) | 1.19 | 1.01 | 0.93 | 1.40 | 1.50 |

EXAMPLE 2

A heat analysis may be conducted to determine whether a furnace configuration of this invention may be utilized for a specified process applied to a material with known physical properties. Heat conduction from the heated barrel to the inner drum at any vertical cross-section through the concentric elements may be determined by the form of Fourier's Equation:

$$Q = \frac{2\pi \cdot L \cdot k \cdot \Delta T^{\circ}\,F.}{\text{Log } n\left(\frac{A1}{A2}\right)}$$

where:

Q=Heat energy in British Thermal Units (BTU) per hour k=Apparent coefficient of conductance of the material A1=The surface area of the inner surface of the barrel A2=Surface area of the outer surface of the drum L=Length of heating zone A similar analysis of radiant heat energy transfer can be conducted, but as noted in Example 1, acceptable results are obtained by considering the entire area A to be in contact with material to the exclusion of radiant heat transfer.

Assuming for purposes of illustration that it is desired to heat a material from an entry temperature of 72° F. at a rate of 500 pounds per hour to an exit temperature of 425° F. and that the characteristics of the material (including an apparent k value of 3.4) indicate that a total heat input of about 270,000 BTU's is required for that purpose, a conductive heat analysis can be used to demonstrate that an available furnace with a heating zone 10 feet long and 2.9 feet in diameter with an annulus 1½ inches wide adapted to heat the contact area of the barrel to 1200° F. is capable of providing only about 188,000 BTU's when the core is rotated to provide the residence time required for the desired production rate. The available furnace would thus not be suitable for this application.

EXAMPLE 3

A horizontal annular furnace of this invention designed for carbon regeneration is considered for its suitability as a retort for recovering mercury from the product of a precipitation system. The precipitate has a bulk density of 75 pounds per cubic foot, and is known to be composed of zinc, gold, silver, diatomaceous earth and residual moisture (following filtration) but to predominate in mercury. The k value of this material is known to be much greater than carbon, in the range of 25 to 50 BTU-inch/hour-ft$^2$ °F. Thus, a furnace with a relatively wide annulus is selected For initial scaling, a design algorithm based upon the much smaller k value (5.5) of carbon is assumed. Table 2 reports the design parameters of the resulting furnace.

TABLE 2

| Parameter | |
|---|---|
| Exit Temperature (°F.) | 850 |
| Specific Heat of Product | 0.1 |
| Annulus Width (inches) | 6 |
| Pounds of Product Per Hour | 450 |
| Percent Moisture In Feed Material | 25 |
| Pounds of Feed Per Hour | 600 |
| Pounds of Water Per Hour | 150 |
| Total Heat Input Required (BTU) | 255183 |
| Total Power Input (kilowatts) | 75 |
| Banks of Heaters | 4 |

TABLE 2-continued

| Parameter | |
|---|---|
| Heaters per Bank | 6 |
| KW per Heater Bank | 18.7 |
| KW Per Heater | 3.12 |
| KW Per Square Foot of Surface Area | 1.33 |
| Length of Heating Zone (feet) | 6.7 |
| Area of Heat Transfer Surface Required (Square Feet) | 87 |
| Diameter of Barrel (feet) | 4.2 |
| Cubic Feet of Material in Annulus | 13.4 |
| Pounds of Material in Annulus | 1005 |
| Number of Blades in Hot Zone | 13 |
| Blade Advance (Inches Per Revolution) | 1 |
| Retention Time in Heating Zone (minutes) | 60 |
| Required Drum Speed (RPM) | 0.6 |

This furnace could be used successfully as a mercury retort, but because the actual k value of the precipitate is much higher than the assumed value, it could be modified considerably; e.g., by reducing the retention time, the heating zone length, or the number of heaters or banks of heaters. Clearly, a smaller less expensive furnace would be preferred for this specific application.

FIGS. 5 through 10 illustrate an embodiment of the invention which can be assembled from components appropriately dimensioned to meet selected design criteria Table 3 identifies various components designated by numerals or letters on the drawings Most of the components listed, notably the shaft 101, shaft seal 102, pillow blocks 103, 121, sight glass tube 105, bushings 106, support saddle 107, the discharge chute 108, revolving lock 109, gussets 110, 118, insulation 111, 116, 125 T beam 112 door hinges 113, skid 114, collar 117, covers 119, the drum drive assembly 120, the join point 122, mounting plates 123, the hopper 126 and similar ancillary structural components will be selected as appropriate, depending upon the dimensions of the major components of the furnace.

TABLE 3

| | |
|---|---|
| 101 | Water Cooled Shaft |
| 102 | Shaft Seal |
| 103 | Self-aligning Pillow Block |
| 104 | Exit End Pillow Block Mount |
| 105 | Sight Glass Tube |
| 106 | Drum Expansion Bushing (slip-fit on shaft) |
| 107 | Heat Transfer Tube (Barrel) Expansion Support Saddle |
| 108 | Product Discharge Chute |
| 109 | Discharge Chute Extension |
| 110 | Front Frame Gussets |
| 111 | Heater Housing Insulation |
| 112 | Steel "T" Beam Shell (Housing) Support |
| 113 | Heating Element Compartment Door Hinges |
| 114 | Rectangular Tube Furnace Skid |
| 115 | Heating Element |
| 116 | Element Back-Up and Spacing Insulation |
| 117 | Hopper Collar |
| 118 | Rear Frame Gussets |
| 119 | Hopper Insulation Cover |
| 120 | Furnace Drum Drive Assembly |
| 121 | Entry Pillow Block Mount |
| 122 | Shaft Drum Join Point |

TABLE 3-continued

| | |
|---|---|
| 123 | Seal Mounting Plate |
| 124 | Furnace Back Frame Plate |
| 125 | Hopper Insulation |
| 126 | Furnace Entry Hopper |
| 127 | Barrel Segment |
| 128 | Hopper Insulation Housing Frame |
| 129 | Main Barrel Segment Collar |
| 130 | Insulation Hangers |
| 131 | Heating Element Access Doors |
| 132 | Rectangular Tube Shell Support Beam |
| 133 | Furnace Shell |
| 134 | Furnace Exhaust (Fume) Pipe |
| 135 | Main Barrel Segment |
| 136 | Exit Assembly Inner Liner |
| 137 | Revolving Drum Assembly (Core) |
| 138 | Exit Assembly |
| 139 | Exit Assembly Insulation |
| 140 | Insulation Cover |
| 141 | Locking Mechanism for Heater Housing |
| 142 | Support Flange |
| 143 | Feed Ports |
| 144 | Hopper Front Plate |
| 145 | Heating Element Retainer Clips |
| 146 | Furnace Exit Frame Plate |
| 147 | Support Member |
| 148 | Anchor Bolts |
| 149 | Product Discharge Ring |
| A-A | Horizontal Center Axis |
| B-B | Vertical Center Line |
| X | Length of Heating Zone |
| X1 | Overall Length of Furnace |
| Y | Diameter of Drum |
| Y1 | Overall Width of Furnace |
| Z | Diameter of Barrel |
| Z1 | Overall Height of Furnace |

Figure 6:
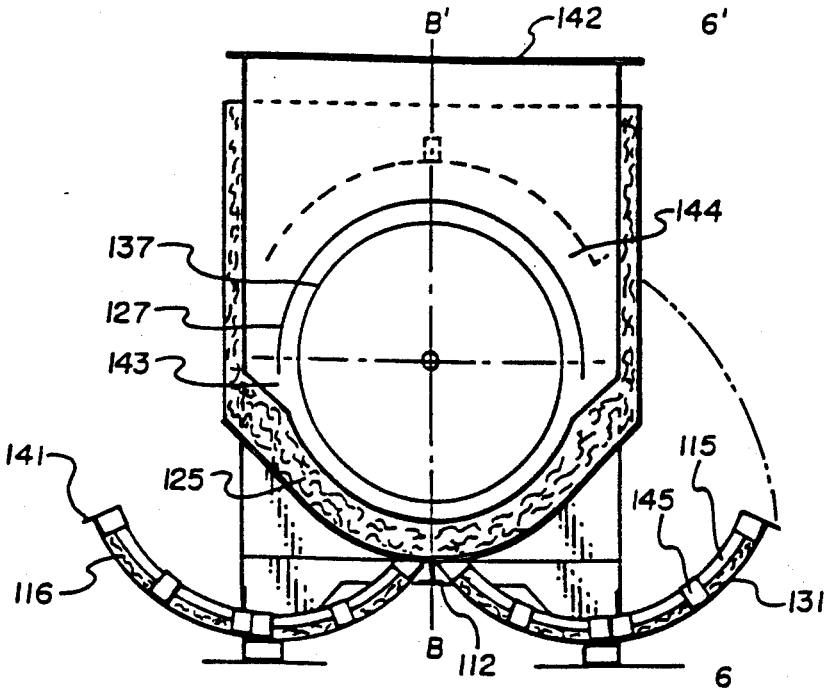
FIG. 6 is a view in cross-section, taken at the reference line 6—6 of FIG. 5, viewed in the direction of the arrows.
Figure 7:
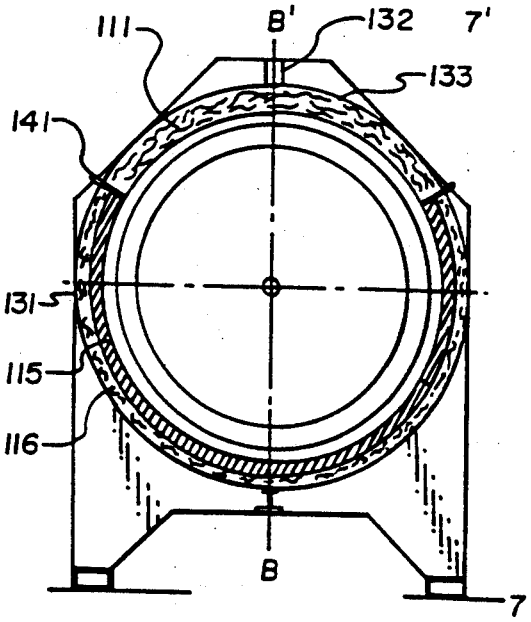
FIG. 7 is a view in cross-section, taken at the reference line 7—7 of FIG. 5, viewed in the direction of the arrows.
Figure 8:
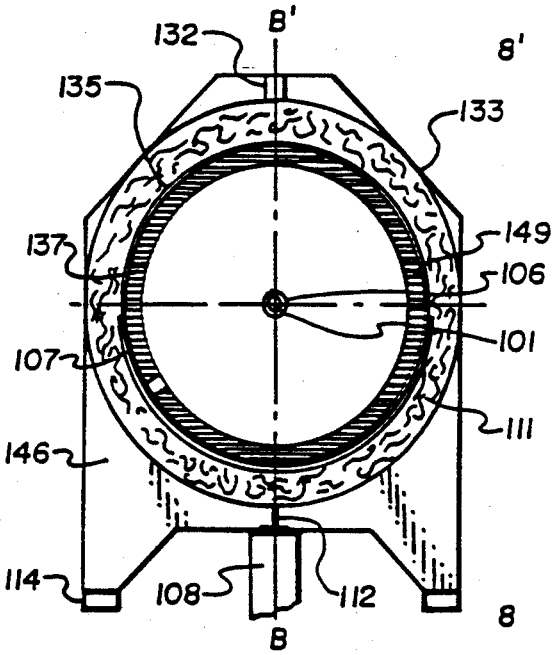
FIG. 8 is a view in cross-section taken at the reference line 8—8 of FIG. 5, viewed in the direction of the arrows.
Figure 9:
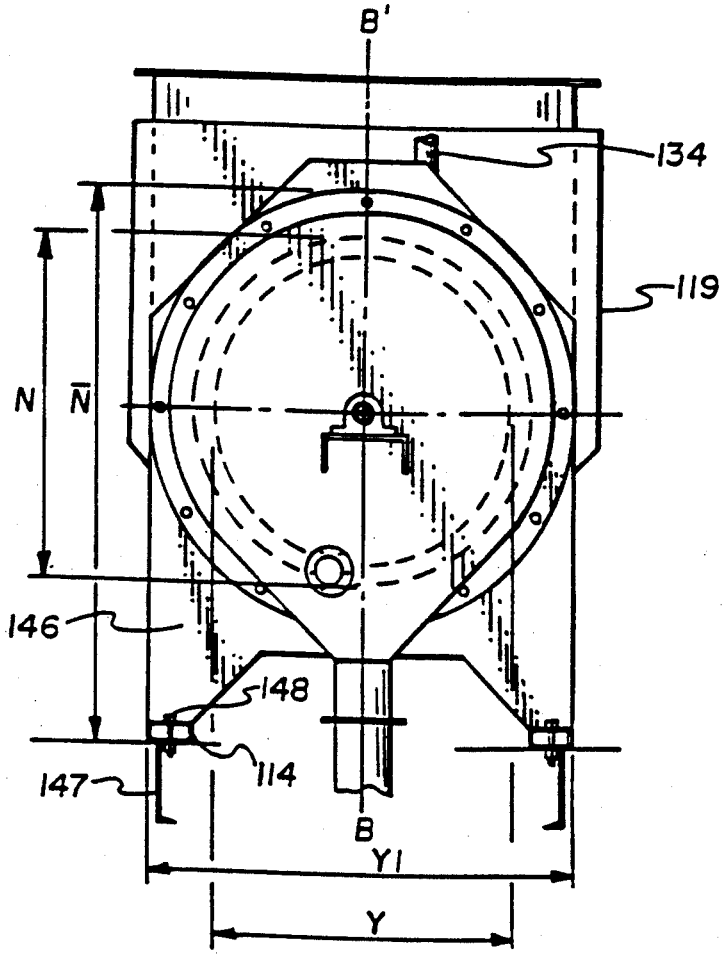
FIG. 9 is a front view of the embodiment of FIG. 5.
Figure 10:
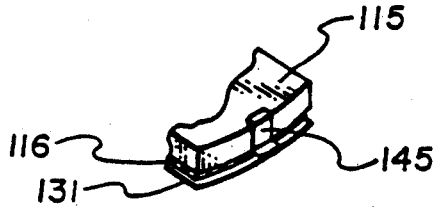
FIG. 10 is a fragmentary pictorial view of an assembly from the region 10—10 of FIG. 5.

As best shown by FIG. 6, the heaters 115 are mounted on hinged doors 131 for easy access and maintenance. Each pair of doors may be regarded as housing a subzone within the heating zone. As illustrated, the feed ports 143 are located to maintain the annulus between the barrel 127, and drum 132 approximately 35 to 40 percent filled.

The barrel element is divided into an end segment and a main segment 135 connected by expansion collars 117, 129 attached to the front hopper plate 144. The hopper is thus unaffected by expansion of the main segment 135 of the barrel.

Although a single vent pipe 105 is illustrated, it is recognized that additional vent locations could be provided along length X the heating zone in applications involving fractional distillation of feed material components.

Materials of construction should be selected based upon the particular process to be conducted in the annulus If the barrel is to be heated above 1500° F., special high temperature alloy should be used. Less expensive materials, such as mild steel, will be satisfactory for many applications. Stainless steel may be appropriate for food processing applications. Some applications which require good heat distribution and effective mixing are nevertheless required to be conducted at low temperatures; e.g. about 200° to about 400° F. The furnace of this invention is suitable for such procedures. A notable characteristic of the horizontal annular furnace of this invention is its ability to handle particulate material of very fine particle size, e.g., 50 microns or smaller.

Reference herein to details of the illustrated and preferred embodiments is not intended to limit the scope of the appended claims, when themselves recite those features regarded as important to the invention.

What is claimed:

1. A furnace, comprising:

stationary structure including a barrel element with a stationary inner surface defining an approximately cylindrical open chamber having a central axis which is oriented substantially inclined from vertical;

heating means positioned to introduce heat to the chamber;

a shaft mounted axially with respect to said central axis to turn within said chamber;

moving structure carried by and rotatable on said shaft, including an approximately cylindrical outer surface positioned approximately concentric with respect to said inner surface and said shaft, wherein to define an approximately annular active zone within said chamber isolated from said shaft; and conveying means associated with said active zone for urging material from an inlet at one end of said chamber towards an outlet at an opposite end of said chamber.

2. A furnace according to claim 1, wherein said moving structure is mounted by means which accommodate expansion, whereby to permit unimpeded axial movement of said moving structure with respect to said stationary structure.

3. A furnace according to claim 1, wherein the cross-sectional area of said active zone is less than about half of the cross-sectional area of said chamber.

4. A furnace according to claim 1, wherein said stationary structure includes a housing which contains said barrel element.

5. A furnace according to claim 4, wherein said barrel element and said heating means are positioned within insulating material contained within said housing.

6. A furnace according to claim 5, wherein said moving structure is mounted by means which accommodate expansion, whereby to permit unimpeded axial movement of said moving structure with respect to said stationary structure.

7. A furnace according to claim 5, wherein the cross-sectional area of said active zone is less than about one-half of the cross-sectional area of said chamber.

8. A furnace according to claim 1 wherein said conveying means comprises a screw conveyor structure carried by said outer surface.

9. A furnace according to claim 8, wherein said screw conveyor structure includes means for avoiding compaction of material being urged through said active zone.

10. A furnace according to claim 9, wherein said screw conveyor structure comprises a series of spaced blade segments which together comprise an interrupted helical blade.

11. A furnace according to claim 10, wherein said moving structure is mounted by means which accommodate expansion, whereby to permit unimpeded axial movement of said moving structure with respect to said stationary structure.

12. A furnace according to claim 11, wherein said stationary structure includes a housing which contains said barrel element.

13. A furnace according to claim 12, wherein said barrel element and said heating means are positioned within insulating material contained within said housing.

14. A furnace according to claim 13, wherein the cross-sectional area of said active zone is less than about one-half of the cross-sectional area of said chamber.

15. A furnace according to claim 1 wherein said central axis is oriented substantially horizontally.

16. A furnace according to claim 15 wherein said heating means is adapted to heat said inner surface.

17. A furnace according to claim 16 wherein said moving structure is mounted by means which accommodate expansion, whereby to permit unimpeded axial movement of said moving structure with respect to said stationary structure.

18. A furnace according to claim 16, wherein the cross-sectional area of said active zone is less than about half of the cross-sectional area of said chamber.

19. A furnace according to claim 16, wherein said stationary structure includes a housing which contains said barrel element.

20. A furnace according to claim 19, wherein said barrel element and said heating means are positioned within insulating material contained within said housing.

21. A furnace according to claim 20, wherein said moving structure is mounted by means which accommodate expansion, whereby to permit unimpeded axial movement of said moving structure with respect to said stationary structure.

22. A furnace according to claim 20, wherein the cross-sectional area of said active zone is less than about one-half of the cross-sectional area of said chamber.

23. A furnace according to claim 20 wherein said conveying means comprises a screw conveyor structure carried by said outer surface.

24. A furnace according to claim 23 wherein said screw conveyor structure includes means for avoiding compaction of material being urged through said active zone.

25. A furnace according to claim 24 wherein said screw conveyor structure comprises a series of spaced blade segments which together comprise an interrupted helical blade.

26. A furnace according to claim 25 wherein said moving structure is mounted by means which accommodate expansion, whereby to permit unimpeded axial movement of said moving structure with respect to said stationary structure.

27. A furnace according to claim 1, including an inlet section at a first end of said chamber, said inlet section including:

a feed hopper with an interior volume constituting means for containing feed material for introduction to said active zone;

a passageway between said feed hopper and said inlet whereby to admit material from said hopper into said active zone; and first sealed journal means for a first end of said shaft adapted to isolate the interior of said chamber from the ambient pressure conditions external said inlet section.

28. A furnace according to claim 27 wherein said central axis is oriented approximately horizontally and said passageway is positioned with respect to the top of said active zone to assure that said active zone remains only partially filled across its vertical cross-sections during operation.

29. A furnace according to claim 28, wherein said passageway comprises ports through said internal surface below the level of said axis.

30. A furnace according to claim 1, including an outlet section, said outlet section including:

second sealed journal means for a second end of said shaft adapted to isolate the interior of said chamber from the ambient pressure conditions external said inlet section; and discharge means for moving material through said outlet while maintaining a pressure seal between said inlet and the interior of said chamber.

31. A furnace according to claim 30, including an inlet section at a first end of said chamber, said inlet section including:

a feed hopper with an interior volume constituting means for containing feed material for introduction to said active zone;

a passageway between said feed hopper and said inlet whereby to admit material from said hopper into said active zone; and first sealed journal means for a first end of said shaft adapted to isolate the interior of said chamber from the ambient pressure conditions external said inlet section.

32. A furnace according to claim 31, including:

a drum element comprising said outer surface mounted to said shaft by means permitting axial movement with respect to the shaft when said drum element expands or contracts in response to changing temperature conditions within said chamber.

33. A furnace according to claim 32 wherein said stationary structure includes a housing which contains said barrel element.

34. A furnace according to claim 33 wherein said barrel element and said heating means are positioned within insulating material contained within said housing.

35. A furnace according to claim 34 wherein said moving structure is mounted by means which accommodate expansion, whereby to permit unimpeded axial movement of said moving structure with respect to said stationary structure.

36. A furnace according to claim 35 wherein said central axis is oriented approximately horizontally and said passageway is positioned with respect to the top of said active zone to assure that said active zone remains only partially filled across its vertical cross-sections during operation.

37. A furnace according to claim 36 wherein said passageway comprises ports through said internal surface below the level of said axis.

38. A furnace according to claim 37 wherein said conveying means comprises a screw conveyor structure carried by said outer surface.

39. A furnace according to claim 38 wherein said screw conveyor structure includes means for avoiding compaction of material being urged through said active zone.

40. A furnace according to claim 39 wherein said screw conveyor structure comprises a series of spaced blade segments which together comprise an interrupted helical blade.

* * * * *

UNITED STATES PATENT OFFICE

CERTIFICATE OF CORRECTION

Patent No. 4,988,289 Dated JANUARY 29, 1991

Inventor(s) ROBERT G. COUCHER

It is certified that error appears in the above-identified patent and that said Letters Patent is hereby corrected as shown below:

In column 7, line 42 after "water", delete "volume" and add --column--.

In column 11, line 39 after "103," delete "121,".

Signed and Sealed this

Fourteenth Day of July, 1992

*Attest:*

DOUGLAS B. COMER

*Attesting Officer*

*Acting Commissioner of Patents and Trademarks*